US006212693B1

(12) United States Patent
D'Aleo

(10) Patent No.: US 6,212,693 B1
(45) Date of Patent: Apr. 10, 2001

(54) SANITARY TOILET SEAT

(76) Inventor: Joseph N D'Aleo, 52-65 72nd Pl., Maspeth, NY (US) 11378

( * ) Notice: Subject to any disclaimer, the term of this patent is extended or adjusted under 35 U.S.C. 154(b) by 0 days.

(21) Appl. No.: 09/579,198

(22) Filed: May 26, 2000

(51) Int. Cl.[7] ..... A47K 13/14

(52) U.S. Cl. ..... 4/244.1; 4/244.2; 4/243.1; 4/243.3

(58) Field of Search ..... 4/244.1, 244.2, 4/243.1, 243.3, 243.2

(56) References Cited

U.S. PATENT DOCUMENTS

| | | | | |
|---|---|---|---|---|
| 1,125,847 | * | 1/1915 | Humphrey . | |
| 1,589,429 | * | 6/1926 | Rouse . | |
| 4,213,212 | * | 7/1980 | Hefty et al. | 4/243 |
| 4,566,648 | * | 1/1986 | Hefty et al. | 4/243 |
| 4,926,504 | | 5/1990 | Higuchi . | |
| 4,928,325 | * | 5/1990 | Higuchi et al. | 4/243 |
| 5,253,372 | * | 10/1993 | Boker | 4/243.2 |
| 5,295,272 | | 3/1994 | Juushi . | |
| 5,381,984 | * | 1/1995 | Hindsgual | 4/244.1 |
| 5,561,867 | | 10/1996 | Roginsky . | |
| 5,913,609 | | 6/1999 | Lorenzi et al. . | |
| 5,937,448 | * | 8/1999 | Brill et al. | 4/243.1 |

* cited by examiner

*Primary Examiner*—Gregory L. Huson
*Assistant Examiner*—Khoa Huynh

(57) ABSTRACT

A sanitary toilet seat is provided which has an integral toilet seat covering material dispenser and disposal device. The device moves a predetermined length of sanitary seat covering material from a dispensing port to a disposal port each time a motor is activated. A pressure sensor is provided for resetting the delay timer in response to high pressure and starting the delay timer in response to low pressure. Once the manually adjustable period of delay has expired, a relay activates a motor, which starts the motion of the covering material about the toilet seat. The motor continues until it is deactivated by a micro switch after one full cycle of operation in which a predetermined length of covering material has been dispensed. A deactivation switch is provided to prevent operation when the seat lid is down, preventing the covering material from being dispensed while the toilet is being used as a seat. The dispensing system provided has a motor driven belt and pulley system, along with a roller-driven disposal system, that pulls the covering material from a covering material dispensing box, and routes it through the seat top where it unfolds to cover the seat. The material is there held by the belts and pulleys such that it follows along the circumference of the seat until the covering material is pulled by rollers back through the seat and into the toilet bowl. The preferred covering material is biodegradable and includes a disinfectant. Batteries power the motor.

27 Claims, 6 Drawing Sheets

SANITARY TOILET SEAT

BACKGROUND OF THE INVENTION

1. Field of the Invention

The present invention relates generally to toilet seat covering material and, more specifically, to a toilet seat having an integral toilet seat covering material dispenser and disposal device therein. The toilet seat covering material dispenser and disposal apparatus is designed to move a predetermined length of sanitary seat covering material from a dispensing port to a disposal port each time a motor is activated. The toilet seat covering material dispenser and disposal system has a pressure sensor for resetting the delay timer in response to high pressure and starting the delay timer in response to low pressure. Once the manually adjustable period of delay has expired, a relay activates a motor, which starts the motion of the covering material about the toilet seat. The motor continues until it is deactivated by a micro switch after one full cycle of operation in which a predetermined length of covering material has been dispensed and discarded. A deactivation switch is attached to the seat top to prevent operation when the seat lid is down. This will prevent the covering material from being dispensed while the toilet is being used as a seat.

The covering material is moved by a motor driven belt and pulley system that dispenses the covering material, and a roller-driven disposal system. The covering material is dispensed from a dispensing box of biodegradable disinfectant continuous seat covering material. A battery power source is provided.

The toilet seat has a top portion and a base, which engage each other to form the toilet seat. The toilet seat base has a number of connector posts with holes for connecting with cooperating posts in the top portion of the toilet seat. The toilet seat base also has an aperture for the disposal of used covering material. In addition to the connector posts, the top portion of the toilet seat has two apertures in the top rear portion for dispensing and disposing of the covering material.

2. Description of the Prior Art

There are other paper dispensing devices designed for toilet seats. Typical of these is U.S. Pat. No. 4,926,504 issued to Higuchi et al. on May 22, 1990.

Another patent was issued to Juushi on Mar. 22, 1994 as U.S. Pat. No. 5,295,272. Yet another U.S. Pat. No. 5,561,867 was issued to Roginsky on Oct. 8, 1996 and still yet another was issued on Jun. 22, 1999 to Lorenzi et al. as U.S. Pat. No. 5,913,609.

U.S. Pat. No. 4,926,504

Inventor: Mitsuhiro Higuchi

Issued: May 22, 1990

A toilet seat structure capable of automatically feeding a seat cover paper onto the toilet seat is disclosed. Since the sheet paper feeding mechanism and a paper cutting mechanism operated by an electronic control unit, a specified length of paper appropriate for covering the toilet seat is automatically and accurately fed and positioned on the toilet seat. After use, the seat covering paper can automatically be cut off. For lavatories at public sites in particular, since the user can operate the apparatus to feed the paper from a functional casing to provide a new seat covering paper on the toilet seat for each use, the user can be assured of a clean toilet seat. Also, since the seat covering paper is held immovable on the toilet seat, the use of the paper covered toilet is made easier.

Laid-on paper delivered from a laid-on paper roll and laid on a toilet seat can be easily separated after use, not requiring hands. A toilet is provided with a delivery roller part for clamping the laid-on paper from a laid-on paper roll, the laid on paper having perforated lines to cut off the laid-on paper for each amount of use, and the delivery roller part pulling out the laid-on paper by the rotation thereof and delivering the laid-on paper onto the toilet seat. A rear portion of the toilet seat is vertically movably provides an upwardly urgingly supported by springs in a rear part of the toilet. A brake mechanism for stopping the rotation of the delivery roller part due to the lowering motion of the toilet seat is also provided.

An apparatus for providing a protective sheet or substrate on the upper surface of a toilet seat includes a supply storage container disposed at a first end of the toilet seat to store a supply of individual protective sheets, each having an opening, and connected in a continuous fashion. The protective sheet extends across the top of the toilet seat and a take-up container disposed at a second end of the toilet seat opposite to the first end is for taking up the sheet after use. A mechanism is provided for advancing the sheet and winding it on a shaft.

Apparatus for conveying a protective covering along a toilet seat is provided. The apparatus includes a housing containing a support structure for the toilet seat, a feeder spool from which a roll of unused protective covering material is fed, a take-up spool for used protective covering and a drive mechanism operated by a water supply system to advance a pre-determined length of the protective covering along the toilet seat, which length generally corresponds to the perimeter of the toilet seat.

While these toilet seat paper dispensing devices may be suitable for the purposes for which they were designed, they would not be as suitable for the purposes of the present invention, as hereinafter described.

SUMMARY OF THE PRESENT INVENTION

A primary object of the present invention is to overcome the shortcomings of the prior art.

Another object of the present invention is to provide a sanitary toilet system.

Another object of the present invention is to provide a sanitary toilet seat having a reservoir of disposable toilet seat covering material.

Yet another object of the present invention is to provide a sanitary toilet seat having means for dispensing the toilet seat covering material.

Still yet another object of the present invention is to provide a sanitary toilet seat having means for positioning a sanitary toilet seat covering material over the toilet seat.

Another object of the present invention is to provide a sanitary toilet seat having means for disposing of used toilet seat covering material as new covering material is being dispensed.

Yet another object of the present invention is to provide a sanitary toilet seat having means for preventing the dispensing or disposal of toilet seat covering material while the toilet seat lid is in the down position.

Still yet another object of the present invention is to provide a user selectable time delay switch for selectively varying the initiation of the dispensing/disposal cycle.

Another object of the present invention is to provide means for selectively replacing the sanitary covering material reservoir.

Additional objects of the present invention will appear as the description proceeds.

The present invention overcomes the shortcomings of the prior art by providing having an integral toilet seat covering material dispenser and disposal device therein. The toilet seat covering material dispenser and disposal apparatus is designed to move a predetermined length of sanitary seat covering material from a dispensing port to a disposal port each time a motor is activated.

The toilet seat covering material dispenser and disposal system has a pressure sensor for resetting the delay timer in response to high pressure and starting the delay timer in response to low pressure. Once the manually adjustable period of delay has expired, a relay activates a motor, which starts the motion of the covering material about the toilet seat. The motor continues until it is deactivated by a micro switch after one full cycle of operation in which a predetermined length of covering material has been dispensed and discarded. A deactivation switch is attached to the seat top to prevent operation when the seat lid is down. This will prevent the covering material from being dispensed while the toilet is being used as a seat.

The covering material is moved by a motor driven belt and pulley system that dispenses the covering material, and by a roller-driven disposal system. The covering material is dispensed from a dispensing box of biodegradable disinfectant continuous seat covering material. A battery power source is provided.

The toilet seat has a top portion and a base, which engage each other to form the toilet seat. The toilet seat base has a number of connector posts with holes for connecting with cooperating posts in the top portion of the toilet seat. The toilet seat base also has an aperture for the disposal of used covering material. In addition to the connector posts, the top portion of the toilet seat has two apertures in the top rear portion for dispensing and disposing of the covering material.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is a perspective of the toilet seat with the integral seat covering material dispenser and disposal system installed. The movement of the seat covering material is shown through one dispensing and disposal cycle. The covering material is shown being dispensed through a slot in the top rear portion of the seat in a counter clockwise direction while the used seat covering material moves through the slot adjacent to the dispensing slot and into the toilet bowl for disposal. The wet end of the discarded covering material within the toilet bowl is intended to break away before or as a result of the flushing action. Also shown attached to the top seat is a deactivation switch that prevents operation when the toilet seat lid is down;

FIG. 2 is a cross sectional view of the toilet seat showing the method by which the seat covering material is secured over the toilet seat top and to the conveying apparatus within it. The dispensing and disposal system consists of a motor driving two belts along a series of pulleys along with the seat covering material originating from a dispenser box. The pulleys serve as belt guides and tensioners and as gripping surfaces for the seat covering material in cooperation with the belts. The covering material is secured to the belt and pulley system by first separating the toilet seat top from its base. The material is then pulled over the top of the seat, and a belt is pulled away from a pulley. The edge of the material is then placed between the pulley and the belt. The belt is then replaced so that the material is sandwiched between the belt and pulley. The procedure is repeated for the opposite edge. The toilet seat base is replaced after the material is secured;

FIG. 3 is an exploded perspective view of the invention;

FIG. 4 is a perspective detail view of the apparatus as described in FIG. 3. The system is activated by the pressure sensor. The pressure sensor detects a change of pressure that occurs when the user gets on and then off the toilet seat. It is located on the bottom of the toilet seat and controls a manually adjustable delay switch. An increase in pressure resets the timer and a decrease activates.

The manually adjustable delay switch allows for a user-determined interval before the relay activates the motor in order to prevent unintended operation due to brief changes in seat pressure.

The dispensing and disposal system consists of a motor driving the seat covering material sandwiched between two belts and a series of pulleys. The pulleys serve as belt guides and tensioners, as well as, gripping surfaces for the seat covering material in cooperation with the belts.

When the motor is activated a portion of material is dispensed, and secured between the pulleys and belts on both edges of the toilet seat. The material then tracks without disengagement. When enough material is deployed, the free end is manually inserted through a top disposal slot and guided through a disposal roller system. The disposal roller system has two rollers which grip the material between them, pull the material off the belt/pulley tracking system, and move the used seat covering material portion through a slot in the top of the seat, through the base slot and into the toilet bowl for disposal. The wet end of the discarded covering material within the toilet bowl will break way before or as a result of the flushing action;

DESCRIPTION OF THE REFERENCED NUMERALS

Figure 1:
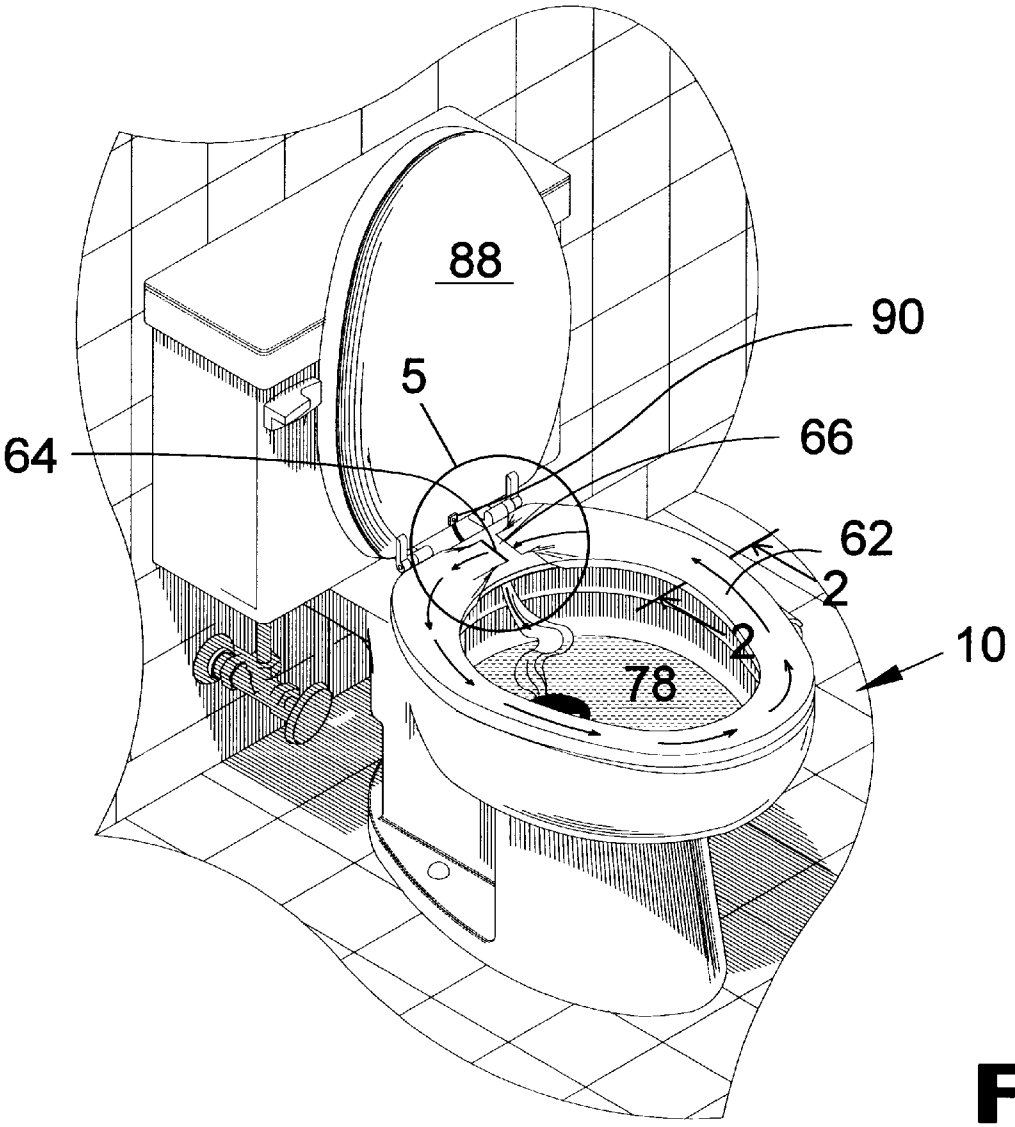

Turning now descriptively to the drawings, in which similar reference characters denote similar elements throughout the several views, the Figures illustrate the sanitary toilet seat of the present invention. With regard to the reference numerals used, the following numbering is used throughout the various drawing figures.

10 sanitary toilet seat of the present invention
20 seat top portion
22 seat base
24 top connector posts
26 base connector posts
28 gap
30 outer driven pulley
32 inner driven pulley
34 outer pulleys
36 inner pulleys
38 posts
40 post female threads
42 screw
44 outer belt
46 inner belt
48 third belt
50 motor
52 first disposal roller
54 second disposal roller
56 disposal roller pulley
58 fourth belt
60 dispensing box
62 covering material
64 dispensing slot
66 seat top portion disposal slot
68 base disposal slot
70 covering material outer edge
72 covering material inner edge
74 top portion outer edge
76 top portion inner edge
78 toilet bowl
80 pressure sensor
82 manually adjustable delay
84 system relay
86 microswitch
88 toilet seat lid
90 deactivation switch
92 power source/batteries

DETAILED DESCRIPTION OF THE PREFERRED EMBODIMENT

Turning now descriptively to the drawings, in which similar reference characters denote similar elements throughout the several views, FIGS. 1 through 6 illustrate the sanitary toilet seat of the present invention indicated generally by the numeral 10.

Figure 2:
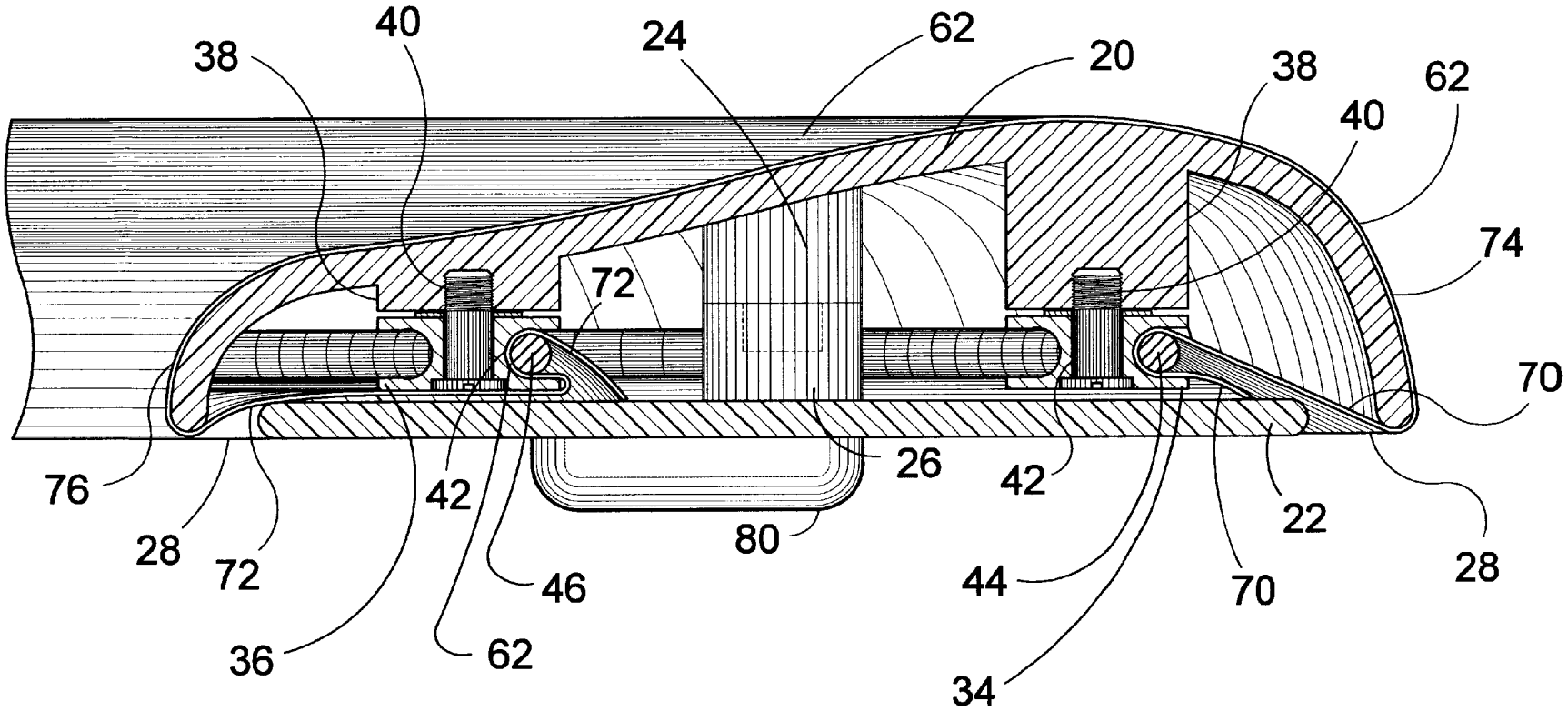
Figure 3:
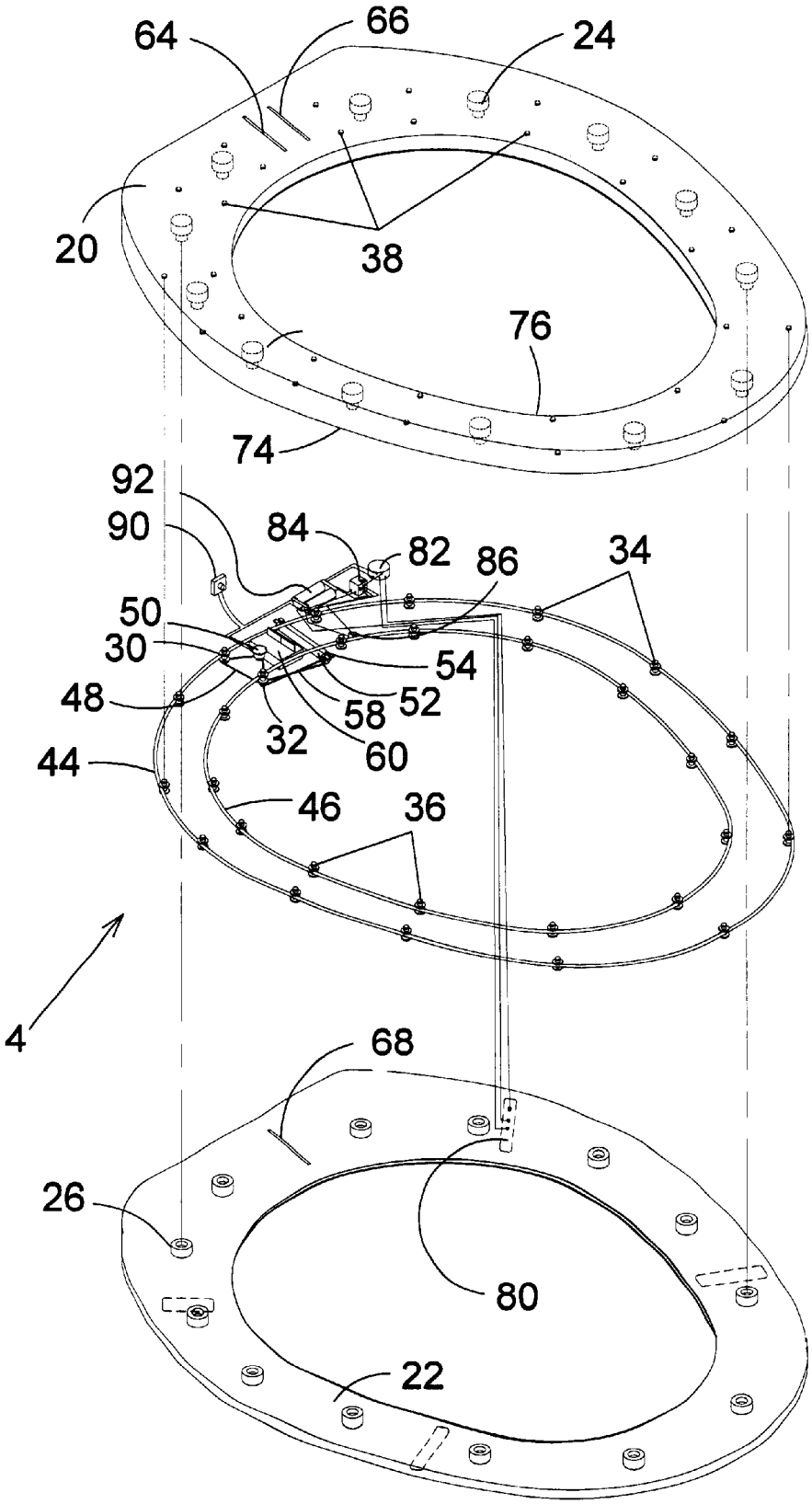

The device 10 is shown in FIG. 1. The device 10 includes a top portion 20 and a base 22. As shown in FIGS. 2 and 3, the top portion 20 is detachably joined to the base 22 by the mating of a series of downwardly facing top connector posts 24 to a corresponding series of upwardly facing base connector posts 26. A gap 28 remains between the top portion 20 and base 22 when joined.

Figure 4:
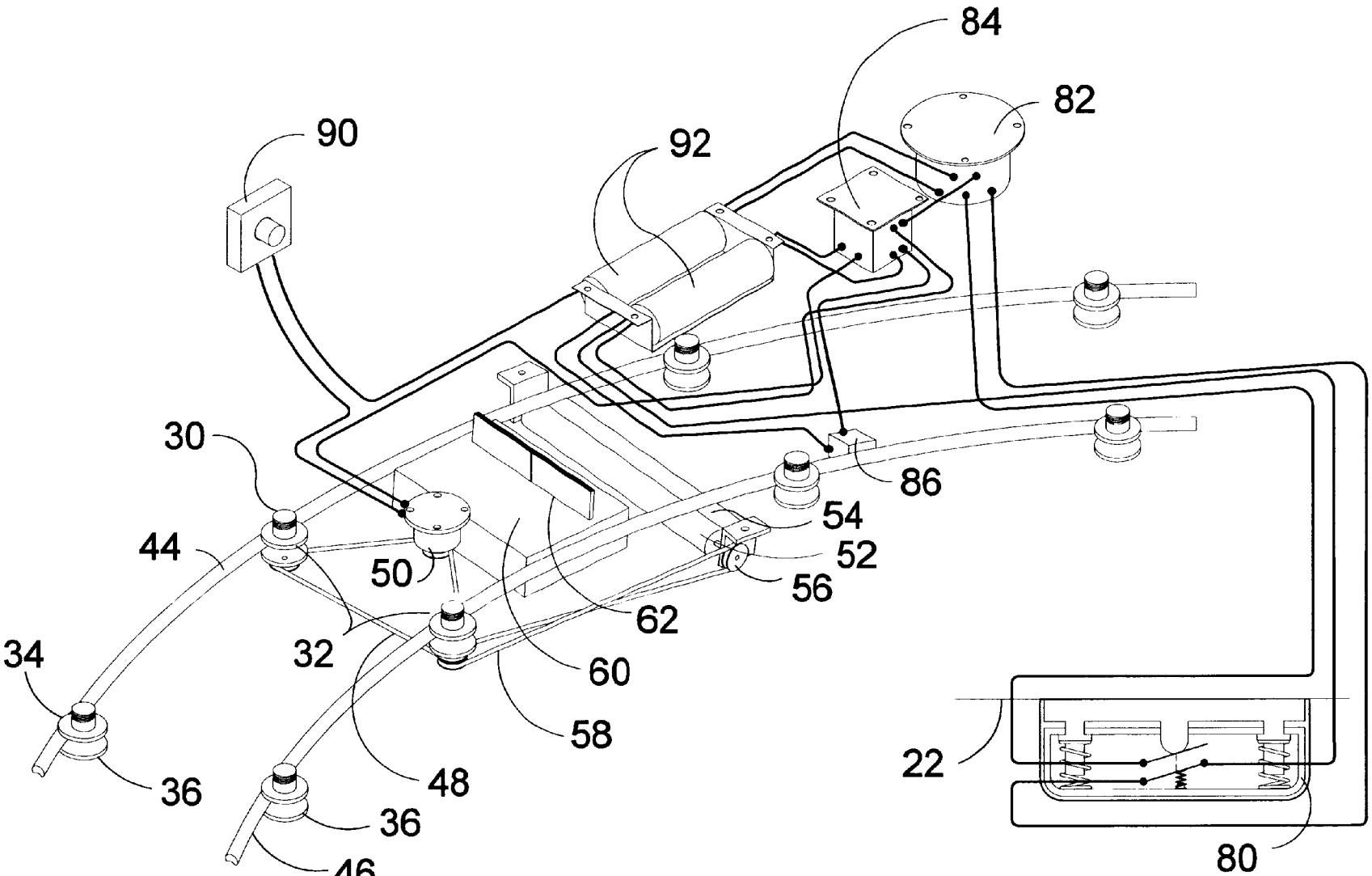
Figure 5:
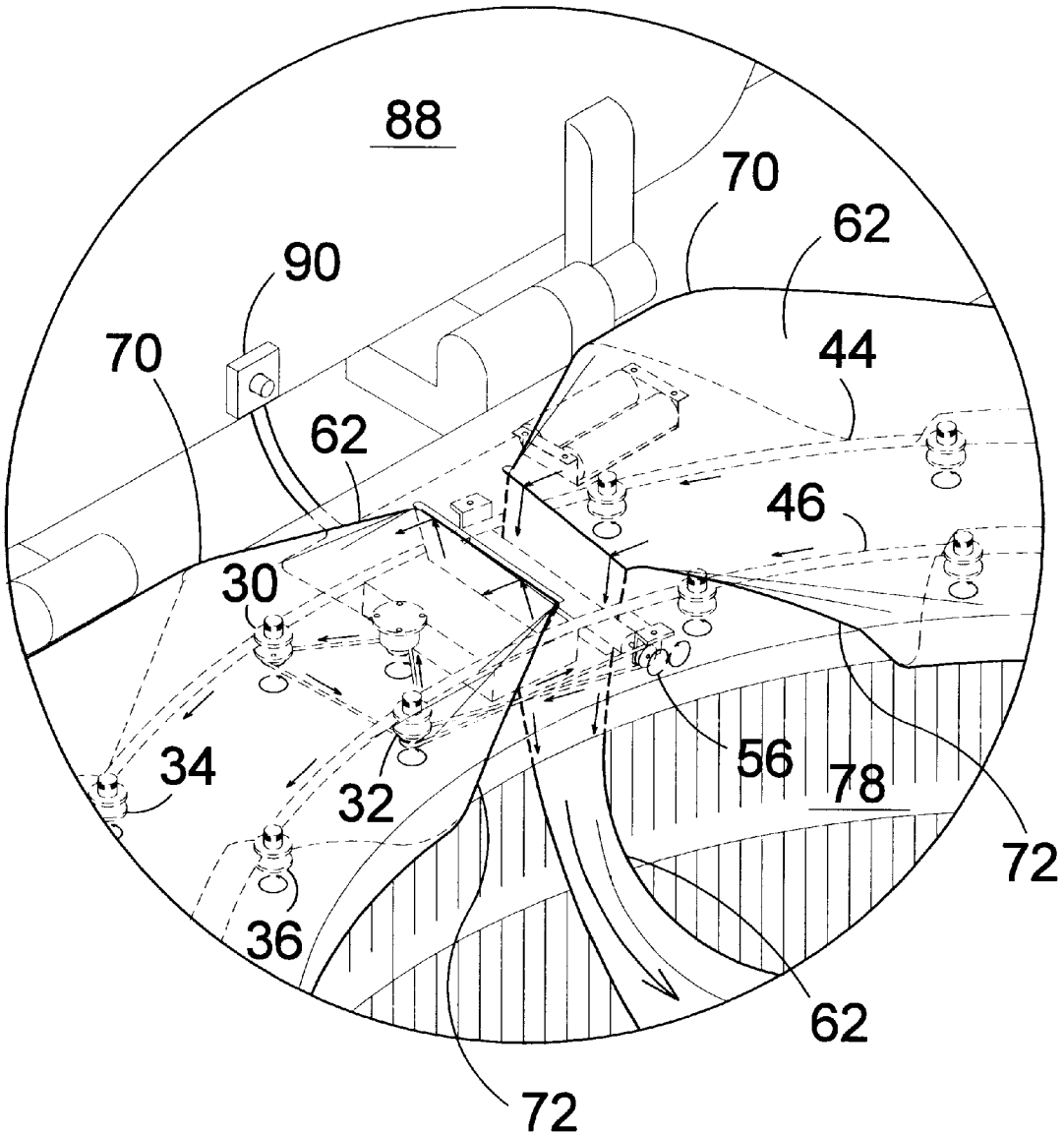
FIG. 5 is a detailed perspective view of the dispensing and disposal operation showing the apparatus and seat covering material in motion.

Attached to the top portion 20 is an outer driven pulley 30 and an inner driven pulley 32, as shown in FIGS. 3 through 5. Also attached to the top portion 20 are a series of outer pulleys 34 and a series of inner pulleys 36. All pulleys 30,32,34,36 are rotatably attached to a series of downwardly facing posts 38 that extend from the top portion 20. In this embodiment the posts 38 have female threads 40 which receive a screw 42 for each pulley 30,32,34,36.

A tensible outer belt 44 encounters each of the outer pulleys 34 and the outer driven pulley 30, as shown in FIGS. 2 through 5. Similarly, a tensible inner belt 46 encounters each of the inner pulleys 36 and the inner driven pulley 32.

In this embodiment, a third belt 48 is rotated by an electric motor 50. The third belt 48 encounters, and rotates, the outer driven pulley 30 and the inner driven pulley 32. Such rotation causes the outer belt 44 and the inner belt 46 to rotate, which in turn rotates the outer pulleys 34 and inner pulleys 36.

Disposal rollers 52 and 54 are attached to the top portion 20. A disposal roller pulley 56 is attached to the first disposal roller 52. A fourth belt 58 encounters the inner driven pulley 32 and the disposal roller pulley 56, causing the disposal roller pulley 56, and the first disposal roller 52 to be rotated when the inner driven pulley 32 is rotated by the third belt 48.

Within the device 10, and at the rear of the seat top portion 20, is a dispenser box 60 containing a folded toilet seat covering material 62, as shown in FIGS. 3 through 5. The covering material 62 is made of a flushable material, such as paper, preferably being biodegradable and including a disinfectant. The covering material 62 is folded, and can be refolded, such that the covering material 62 may be passed from the dispensing box 60, through a dispensing slot 64 in the top portion 20, through a disposal slot 66 in the top portion 20, and through a disposal slot 68 in the base 22.

The covering material 62, when unfolded, has an outer edge 70 and an inner edge 72, the width of the unfolded covering material 62 being sufficient to overhang the top portion outer edge 74 and top portion inner edge 76.

In the expected use of the device 10, the covering material 62 will be unfolded after being passed from the dispenser box 60 through the dispensing slot 64. The covering material outer edge 70 will then overhang the top portion outer edge 74 to the extent that the covering material outer edge 70 can be tucked between a temporarily stretched outer belt 44 and each of the outer pulleys 34. The gap 28 enables this routing. When returned to the normal position, the outer belt 44 firmly secures the covering material outer edge 74 against each outer pulley 34, around the top portion outer edge 74, as particularly shown in FIG. 2.

Figure 6:
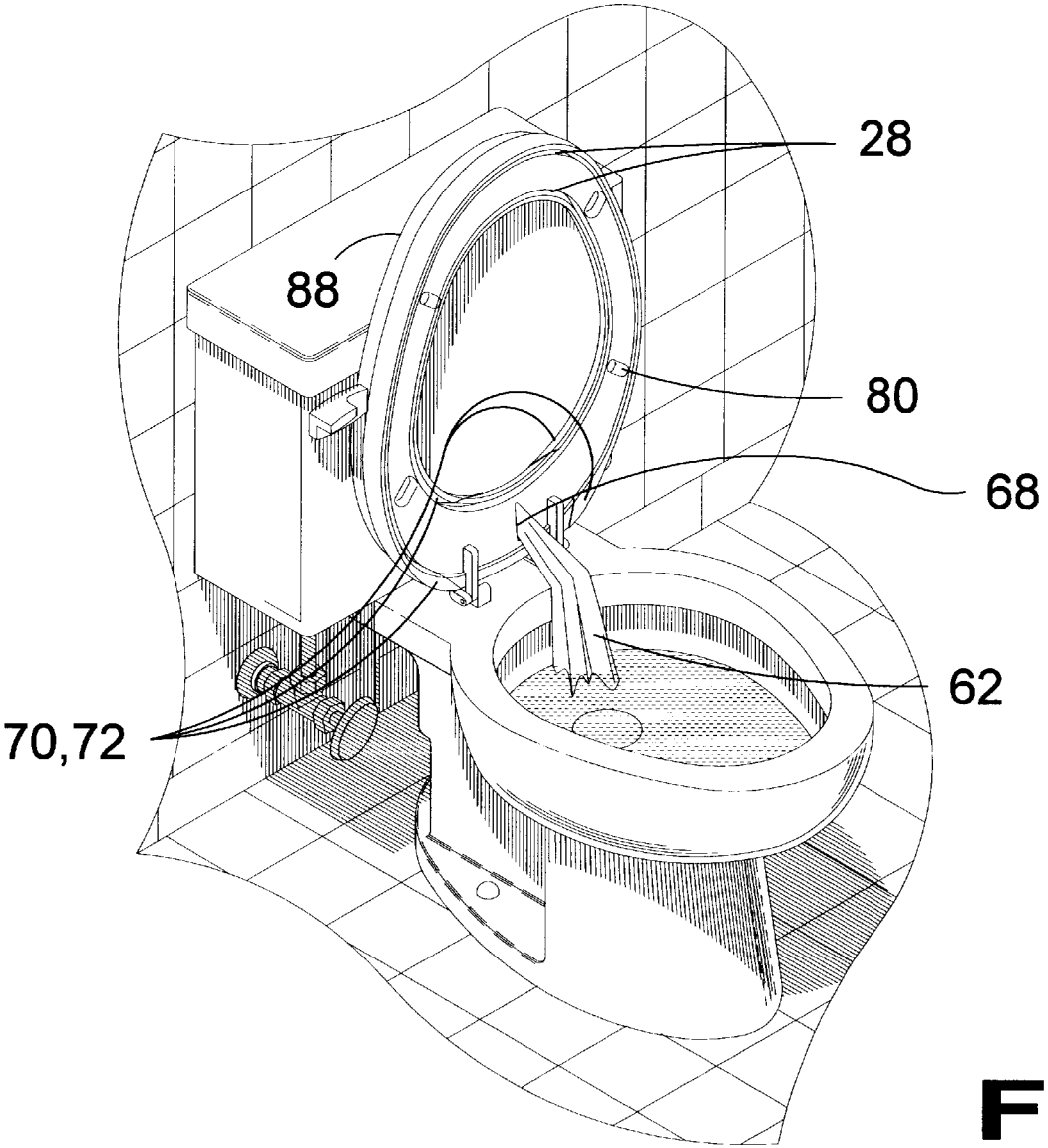
FIG. 6 is a perspective view of the toilet seat bottom showing the seat covering material access gap between the top and base, the pressure sensor, the covering material entering and exiting at the gap at the bottom of the base, and the used seat covering material exiting the slot in the base into the toilet bowl.

FIGS. 2 and 6 shows a similar configuration for the covering material inner edge 72, which overhangs the top portion inner edge 76 to an extent that the covering material inner edge 72 may be routed and secured between the inner belt 46 and each of the inner pulleys 36.

When the covering material outer edge 70 and the covering material inner edge 72 are so secured against the outer pulleys 34 and inner pulleys 36, the rotation of the outer belt 44 and inner belt 46 causes the covering material 62 to move circumferentially around the top portion 20. This movement begins at the dispensing slot 64, and ends as the refolded covering material 62 passes through the top portion disposal slot 66, then through the disposal rollers 52,54, then the base disposal slot 68, and then into the toilet bowl 78.

The disposal rollers 52, 54 are spaced such that the rotation of the first disposal roller 52 pulls the covering material 62 through the top portion disposal slot 66, and pushes the covering material 62 through the base disposal slot 68. This pulling function can be supplemental to, or in place of, the covering material 62 moving function of the third belt 48, outer driven pulley 30, and inner driven pulley 32 combination. Similarly, the latter combination can provide necessary covering material 62 motion in the absence of the disposal rollers 52, 54.

The motor 50 can be activated by conventional on-off buttons or switches. As shown in FIGS. 3 and 4, however, this embodiment includes a pressure sensor 80 that is positioned to respond to the weight of a person seated on the seat top portion 20. The pressure sensor 80 initiates a manually adjustable delay 82 that, at the predetermined time following initiation by the pressure sensor 80, will initiate a system relay 84 that activates the motor 50. As discussed above, the motor 50 turns the third belt 48, causing the outer belt 44 and inner belt 46 to be rotated, as well as, the disposal rollers 52. As a result the covering material 62 is moved around the top portion 20 and eventually into the toilet bowl 78.

A microswitch 86 is set to deactivate the motor 50 after one cycle of operation, during which the appropriate amount of the covering material 62 has been added through the dispensing slot 64, and eliminated into the toilet bowl 78.

In some instances, users lower the toilet seat lid 88 and use the toilet as a chair. A deactivation switch 90 is provided which is positioned such that the entire activation system is overridden when the toilet seat lid 88 is down.

The motor 50 can be powered by conventional means including the batteries 92 shown in FIG. 4.

In other embodiments (not shown), the disposal slots 66,68 and disposal rollers 52,54 are eliminated, allowing used covering material 62 to drape from the toilet seat top portion 20, directly into the toilet bowl 78. A perforated covering material can be used in this embodiment.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An improved toilet seat of the type that is hingedly connected to a toilet bowl, that is covered by a toilet lid when not in use, and that can be covered by a covering material when in use, comprising:

(a) the toilet seat, the toilet seat having a top portion and a base, the toilet seat top portion and base being detachably joined, the toilet seat top portion having an outer edge, an inner edge, and a rear surface, the rear surface having a dispensing aperture and a disposal aperture, the toilet seat base having a disposal aperture, the disposal aperture being aligned with the toilet seat top portion rear surface disposal aperture;

(b) a first belt;

(c) a second belt;

(d) an outer driven pulley rotatably affixed to the toilet seat top portion;

(e) an inner driven pulley rotatably affixed to the toilet seat top portion;

(f) a first plurality of pulleys rotatably affixed to the toilet seat top portion, the first belt being pullably positioned on the first plurality of pulleys and on the outer driven pulley, the first plurality of pulleys being positioned on the toilet seat top portion such that the first belt path is generally proximate the toilet seat top portion outer edge;

(g) a second plurality of pulleys rotatably affixed to the toilet seat top portion, the second belt being pullably positioned on the second plurality of pulleys and on the inner driven pulley, the second plurality of pulleys being positioned on the toilet seat top portion such that the second belt path is generally proximate the toilet seat top portion inner edge;

(h) a motor;

(i) a motor drive, the motor drive being positioned such that the motor causes the motor drive to rotate the outer and inner driven pulleys, such rotation causing the first belt and second belt to rotate about the first and second pluralities of pulleys, respectively;

(j) and further wherein the covering material has an outer and inner edge, the covering material being folded as the covering material passes through the toilet seat top portion dispensing aperture, the covering material being unfolded after such passage, the covering material outer edge being secured between the first belt and each of the first plurality of pulleys, the covering material inner edge being secured between the second belt and each of the second plurality of pulleys, the covering material being refolded prior to passage of the covering material through the toilet seat top portion rear surface disposal aperture and the toilet seat base disposal aperture.

2. The improvement of claim 1, further comprising:

(a) a roller belt, the roller belt being positioned on the inner driven pulley, such that the roller belt is rotated by the motor; and (b) a pair of adjacent rollers positioned between the toilet seat top portion rear surface disposal aperture and the toilet seat base disposal aperture, such that the flushable covering material is pulled by the rollers through the toilet seat top portion rear surface disposal aperture, at least one of the rollers being rotated by the roller belt.

3. The improvement of claim 1, wherein the motor drive comprises a third belt, the third belt being positioned to rotate the outer and inner driven pulleys.

4. The improvement of claim 3, wherein the microswitch is positioned to detect the motion of the third belt.

5. The improvement of claim 1, wherein the top portion and base are shaped and joined such that an outer gap is formed between the top portion outer edge and the base, and an inner gap is formed between the top portion inner edge and the base, the covering material outer edge being routed through the outer gap, the covering material inner edge being routed through the inner gap.

6. The improvement of claim 1, wherein the covering material is flushable.

7. The improvement of claim 1, wherein the toilet seat top portion dispensing aperture is slot-shaped.

8. The improvement of claim 1, wherein the toilet seat top portion rear surface disposal aperture is slot-shaped.

9. The improvement of claim 1, wherein the toilet seat base disposal aperture is slot-shaped.

10. The improvement of claim 1, wherein the outer driven pulley and the inner driven pulley each have a groove in which the first belt and second belt are respectively positioned.

11. The improvement of claim 1, wherein the first and second pluralities of pulleys each have a groove in which the first belt and second belt are respectively positioned.

12. The improvement of claim 1, further comprising a delay timer, a relay, a pressure sensor, and a microswitch, the pressure sensor being positioned to transmit a high pressure signal when an occupant sits upon the toilet seat top portion, the pressure sensor being further positioned to transmit a low pressure signal when the occupant leaves the seated position on the toilet seat top portion, the delay timer being reset by the high pressure signal from the pressure sensor, the delay timer being activated by the low pressure signal from the pressure sensor, the relay transmitting an activation signal to the motor in response to a signal from the delay timer at the end of the timed delay, the motor stopping in response to a signal from the microswitch, the microswitch being positioned to detect the motion of one of the belts, the microswitch being set to stop the motor after a predetermined amount of belt motion.

13. The improvement of claim 12, wherein the microswitch is positioned to detect the motion of the first belt.

14. The improvement of claim 12, wherein the microswitch is positioned to detect the motion of the second belt.

15. The improvement of claim 12, wherein the delay timer is manually adjustable such that the period of delay can be varied.

16. The improvement of claim 1, further comprising a deactivation switch, the deactivation switch being positioned to be triggered when the toilet lid is down, such that the motor cannot be activated while the toilet lid is down.

17. The improvement of claim 1, further comprising a power source for the motor.

18. The improvement of claim 17, wherein the power source comprises one or more batteries.

19. The improvement of claim 1, further comprising a battery holder positioned between the top portion and the base, the battery holder being in electronic communication with the motor.

20. The improvement of claim 1, further comprising a switch for starting and stopping the motor.

21. The improvement of claim 20, wherein the switch is manually operated.

22. An improved toilet seat of the type that is hingedly connected to a toilet bowl and that is covered by a toilet lid when not in use, comprising:

(a) the toilet seat, the toilet seat having a top portion and a base, the toilet seat top portion and base being detachably joined, the toilet seat top portion having an outer edge, an inner edge, and a rear surface, the rear surface having a dispensing aperture and a disposal aperture, the toilet seat base having a disposal aperture, the disposal aperture being aligned with the toilet seat top portion rear surface disposal aperture;

(b) a first belt;

(c) a second belt;

(d) an outer driven pulley rotatably affixed to the toilet seat top portion;

(e) an inner driven pulley rotatably affixed to the toilet seat top portion;

(f) a first plurality of pulleys rotatably affixed to the toilet seat top portion, the first belt being pullably positioned on the first plurality of pulleys and on the outer driven pulley, the first plurality of pulleys being positioned on the toilet seat top portion such that the first belt path is generally proximate the toilet seat top portion outer edge;

(g) a second plurality of pulleys rotatably affixed to the toilet seat top portion, the second belt being pullably positioned on the second plurality of pulleys and on the inner driven pulley, the second plurality of pulleys being positioned on the toilet seat top portion such that the second belt path is generally proximate the toilet seat top portion inner edge;

(h) a motor;

(i) a motor drive, the motor drive being positioned such that the motor causes the motor drive to rotate the outer and inner driven pulleys, such rotation causing the first belt and second belt to rotate about the first and second pluralities of pulleys, respectively;

(j) a covering material, the covering material having an outer edge and an inner edge, the covering material being folded as the covering material passes through the toilet seat top portion dispensing aperture, the covering material being unfolded after such passage, the covering material outer edge being secured between the first belt and each of the first plurality of pulleys, the covering material inner edge being secured between the second belt and each of the second plurality of pulleys, the covering material being refolded prior to passage of the covering material through the toilet seat top portion rear surface disposal aperture and the toilet seat base disposal aperture;

(k) a roller belt, the roller belt being positioned on the inner driven pulley, such that the roller belt is rotated by the motor; and (l) a pair of adjacent rollers positioned between the toilet seat top portion rear surface disposal aperture and the toilet seat base disposal aperture, such that the covering material is pulled by the rollers through the toilet seat top portion rear surface disposal aperture, at least one of the rollers being rotated by the roller belt.

23. The improvement of claim 22, wherein the covering material is flushable.

24. The improvement of claim 22, further comprising a dispensing box for storing the covering material prior to the dispensing of the covering material.

25. The improvement of claim 24, wherein the dispensing box is positioned within the toilet seat top portion and base.

26. An improved toilet seat of the type that is hingedly connected to a toilet bowl, that is covered by a toilet lid when not in use, and that can be covered by a covering material when in use, comprising:

(a) the toilet seat, the toilet seat having a top portion and a base, the toilet seat top portion and base being detachably joined, the toilet seat top portion having an outer edge, an inner edge, and a rear surface, the rear surface having a dispensing aperture;

(b) a first belt;

(c) a second belt;

(d) an outer driven pulley rotatably affixed to the toilet seat top portion;

(e) an inner driven pulley rotatably affixed to the toilet seat top portion;

(f) a first plurality of pulleys rotatably affixed to the toilet seat top portion, the first belt being pullably positioned on the first plurality of pulleys and on the outer driven pulley, the first plurality of pulleys being positioned on the toilet seat top portion such that the first belt path is generally proximate the toilet seat top portion outer edge;

(g) a second plurality of pulleys rotatably affixed to the toilet seat top portion, the second belt being pullably positioned on the second plurality of pulleys and on the inner driven pulley, the second plurality of pulleys being positioned on the toilet seat top portion such that the second belt path is generally proximate the toilet seat top portion inner edge;

(h) a motor; and (i) a motor drive, the motor drive being positioned such that the motor causes the motor drive to rotate the outer and inner driven pulleys, such rotation causing the first belt and second belt to rotate about the first and second pluralities of pulleys, respectively;

(j) and further wherein the covering material has an outer and inner edge, the covering material being folded as the covering material passes through the toilet seat top portion dispensing aperture, the covering material being unfolded after such passage, the covering material outer edge being secured between the first belt and each of the first plurality of pulleys, the covering material inner edge being secured between the second belt and each of the second plurality of pulleys.

27. An improved toilet seat of the type that is hingedly connected to a toilet bowl, that is covered by a toilet lid when not in use, and that can be covered by a covering material when in use, comprising:

(a) the toilet seat, the toilet seat having a top portion and a base, the toilet seat top portion and base being detachably joined, the toilet seat top portion having an outer edge, an inner edge, and a rear surface, the rear surface having a dispensing aperture and a disposal aperture, the toilet seat base having a disposal aperture, the disposal aperture being aligned with the toilet seat top portion rear surface disposal aperture;

(b) a first belt;

(c) a second belt;

(d) a first plurality of pulleys rotatably affixed to the toilet seat top portion, the first belt being pullably positioned on the first plurality of pulleys, the first plurality of pulleys being positioned on the toilet seat top portion such that the first belt path is generally proximate the toilet seat top portion outer edge;

(e) a second plurality of pulleys rotatably affixed to the toilet seat top portion, the second belt being pullably positioned on the second plurality of pulleys, the second plurality of pulleys being positioned on the toilet seat top portion such that the second belt path is generally proximate the toilet seat top portion inner edge;

(f) a pair of adjacent rollers positioned between the toilet seat top portion rear surface disposal aperture and the toilet seat base disposal aperture;

(g) a motor; and (h) a motor drive, the motor drive being positioned such that the motor causes the motor drive to rotate at least one of the rollers;

(i) and further wherein the covering material has an outer and inner edge, the covering material being folded as the covering material passes through the toilet seat top portion dispensing aperture, the covering material being unfolded after such passage, the covering material outer edge being secured between the first belt and each of the first plurality of pulleys, the covering material inner edge being secured between the second belt and each of the second plurality of pulleys, the covering material being refolded prior to passage of the covering material through the toilet seat top portion rear surface disposal aperture and the toilet seat base disposal aperture, the folded covering material being pulled through the toilet seat top portion rear surface disposal aperture by the rotation of the rollers.

* * * * *